US009629487B1

(12) United States Patent
Kvitek

(10) Patent No.: US 9,629,487 B1
(45) Date of Patent: Apr. 25, 2017

(54) BI-ELEVATION PILLOW SYSTEM

(71) Applicant: Kyle M. Kvitek, Denver, CO (US)

(72) Inventor: Kyle M. Kvitek, Denver, CO (US)

( * ) Notice: Subject to any disclaimer, the term of this patent is extended or adjusted under 35 U.S.C. 154(b) by 290 days.

(21) Appl. No.: 14/611,540

(22) Filed: Feb. 2, 2015

Related U.S. Application Data

(63) Continuation-in-part of application No. 13/902,545, filed on May 24, 2013, now Pat. No. 8,973,191, which is a continuation-in-part of application No. 13/533,720, filed on Jun. 26, 2012, now abandoned, which is a continuation-in-part of application No. 12/880,148, filed on Sep. 12, 2010, now abandoned, which is a continuation-in-part of application No. 12/425,287, filed on Apr. 16, 2009, now abandoned.

(51) Int. Cl.
*A47G 9/10* (2006.01)

(52) U.S. Cl.
CPC ..... *A47G 9/10* (2013.01)

(58) Field of Classification Search
CPC ..... A47G 9/10
USPC ..... 5/632, 636, 640, 652, 657
See application file for complete search history.

(56) References Cited

U.S. PATENT DOCUMENTS

| | | | | |
|---|---|---|---|---|
| 1,701,124 | A * | 2/1929 | Safford | A47C 27/125 5/636 |
| 4,850,068 | A | 7/1989 | Walpin et al. | |
| 4,987,625 | A | 1/1991 | Edelson | |
| 5,029,350 | A | 7/1991 | Edelson | |
| 5,271,114 | A | 12/1993 | Kjersem | |
| 5,471,691 | A | 12/1995 | Ryndak | |
| D381,234 | S | 7/1997 | Lupoff | |
| D387,599 | S * | 12/1997 | Ryndak | A47C 27/125 D6/601 |
| 5,765,245 | A | 6/1998 | Breto | |
| D446,676 | S | 8/2001 | Mayes | |
| 6,270,155 | B1 | 8/2001 | Rashid | |
| 6,336,236 | B1 | 1/2002 | Dalton | |
| 7,305,728 | B2 | 12/2007 | Schlieps | |
| D618,944 | S | 7/2010 | Rothstein et al. | |
| 2004/0226096 | A1 | 11/2004 | Davis | |
| 2006/0064821 | A1 | 3/2006 | Pruitt | |
| 2007/0107131 | A1 | 5/2007 | Fux | |
| 2008/0028530 | A1 | 2/2008 | Hao | |

* cited by examiner

*Primary Examiner* — Fredrick Conley

(57) ABSTRACT

A bi-elevation pillow system for allowing two users to lie side by side with each of their heads respectively positioned at a different elevation by using the pillow system has a base pillow member with a general shape of a rectangular prism. The base pillow member has a cavity with a cushion component located inside. The system has a secondary pillow member with a general shape of a rectangular prism with a cavity having a cushion component located inside. In a first position for storage, the base pillow bottom surface is rotated against and interfaces with a secondary pillow bottom surface. In a second position for use, the secondary pillow is rotated about a hinge 180 degrees in an open configuration and placed on a ground surface for use.

20 Claims, 16 Drawing Sheets

(ISO View)

(ISO Open View)

(ISO View)

(ISO Open View)

BI-ELEVATION PILLOW SYSTEM

CROSS REFERENCE

This application claims priority to U.S. non-provisional application Ser. No. 13/902,545 filed May 24, 2013, which is a continuation-in-part of U.S. non-provisional application Ser. No. 13/533,720 filed Jun. 26, 2012, which is a continuation-in-part of U.S. non-provisional application Ser. No. 12/880,148 filed Sep. 12, 2010, which is a continuation-in-part of U.S. non-provisional application Ser. No. 12/425,287 filed Apr. 16, 2009, the specifications of which are incorporated herein by reference in its entirety.

BACKGROUND OF THE INVENTION

On many occasions, two people may wish to watch television simultaneously while lying close to each other while on a couch, a bed or the floor. It is often difficult for the two individuals to position their respective heads comfortably and still see the television. Sometimes, one or both individuals may prop their head up with a hand or an arm to see the television. Generally, it is common for the individual in the back to have difficulties seeing the television due to the head of the individual positioned in the front blocking their view. The present invention features a bi-elevation pillow system for allowing two users to lie side by side with each of their heads respectively positioned at a different elevation by using the pillow system.

SUMMARY

The present invention features a bi-elevation pillow system for allowing two users to lie side by side with each of their heads respectively positioned at a different elevation by using the pillow system. In some embodiments the system comprises a base pillow member comprising a general shape of a rectangular prism. In some embodiments, a base pillow bottom surface may further comprise a linear channel located thereon. In some embodiments, the base pillow member further comprises a cavity having a cushion component located therein.

In some embodiments, the system comprises a secondary pillow member comprising a general shape of a rectangular prism. In some embodiments, the secondary pillow member further comprises a cavity having a cushion component located therein.

In some embodiments, in a first position for storage, the base pillow bottom surface interfaces with a secondary pillow bottom surface and is secured in the first position by a first attachment component and a second attachment component. In some embodiments, in a second position for use, the secondary pillow is rotated about a hinge 180 degrees. In some embodiments, the base pillow bottom surface and the secondary pillow bottom surface are placed on a ground surface for use.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
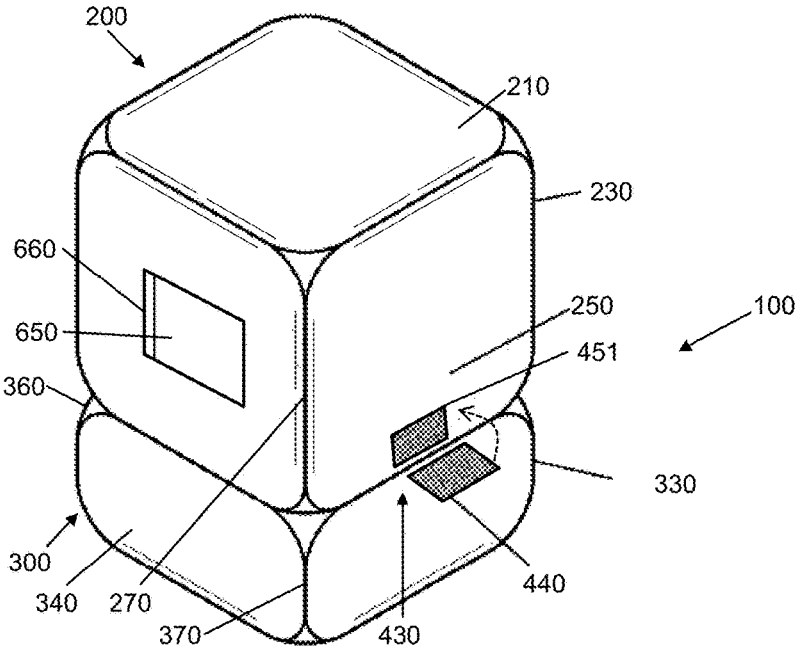
FIG. 1 is a perspective view of the present invention in a first position for storage.

Following is a list of elements corresponding to a particular element referred to herein:

100 Bi-elevation pillow system
200 Base pillow member
210 Base pillow top surface
220 Base pillow bottom surface
230 Base pillow first side
240 Base pillow second side
250 Base pillow third side
260 Base pillow fourth side
270 Base pillow edge
280 Linear channel
282 Channel first end
284 Channel second end
300 Secondary pillow member
310 Secondary pillow top surface

Figure 2:
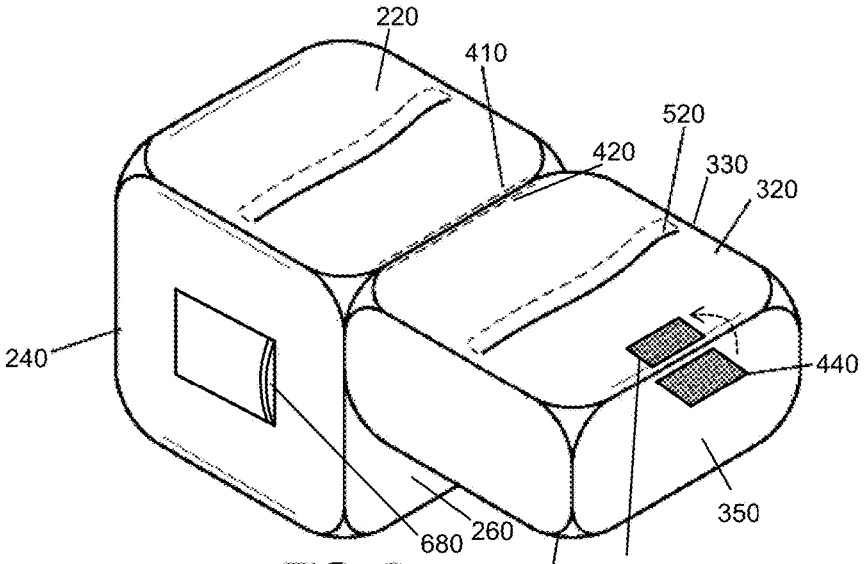
FIG. 2 is a perspective view of the present invention in a second position for use.
Figure 3:
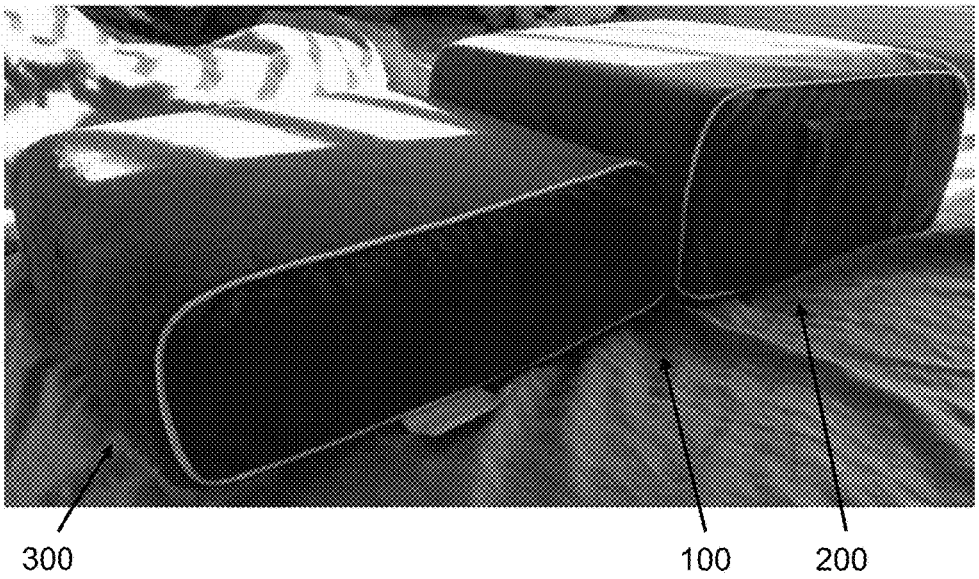
FIG. 3 is a perspective view of the present invention in a second position for use.
Figure 4:
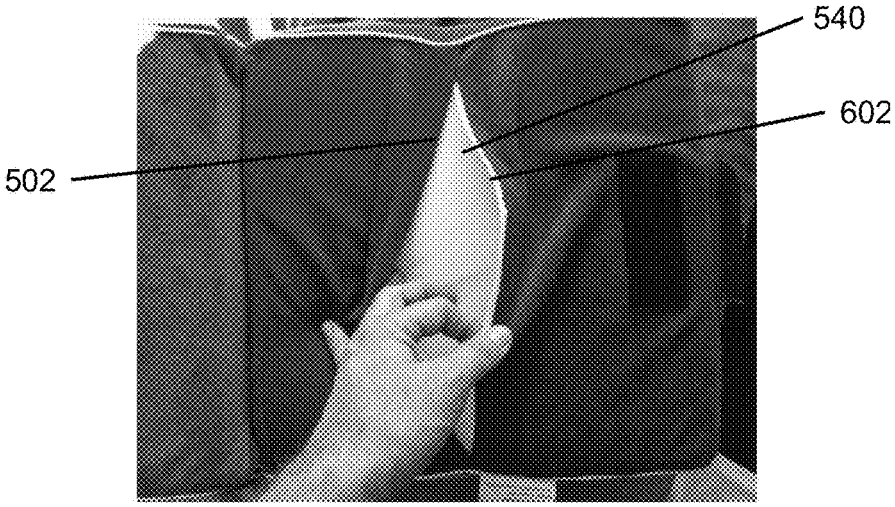
FIG. 4 shows the details of an access aperture of the present invention.
Figure 5:
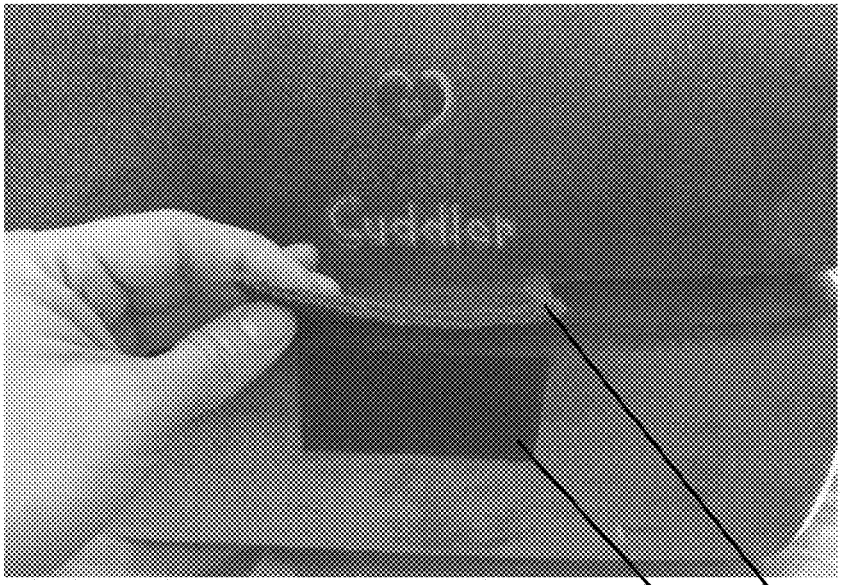
FIG. 5 shows the attachment system of the present invention.
Figure 6:
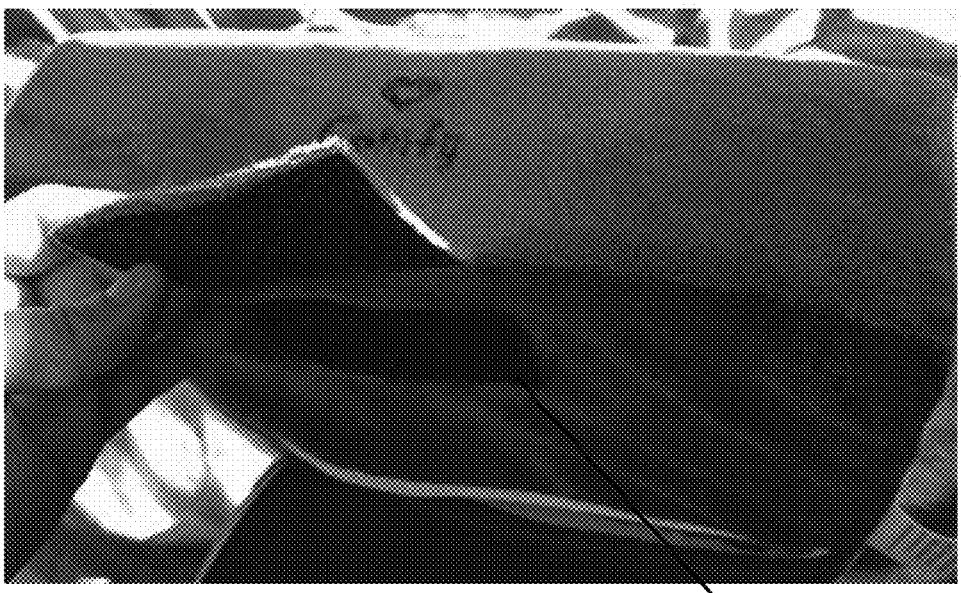
FIG. 6 shows the attachment system of the present invention.
Figure 7:
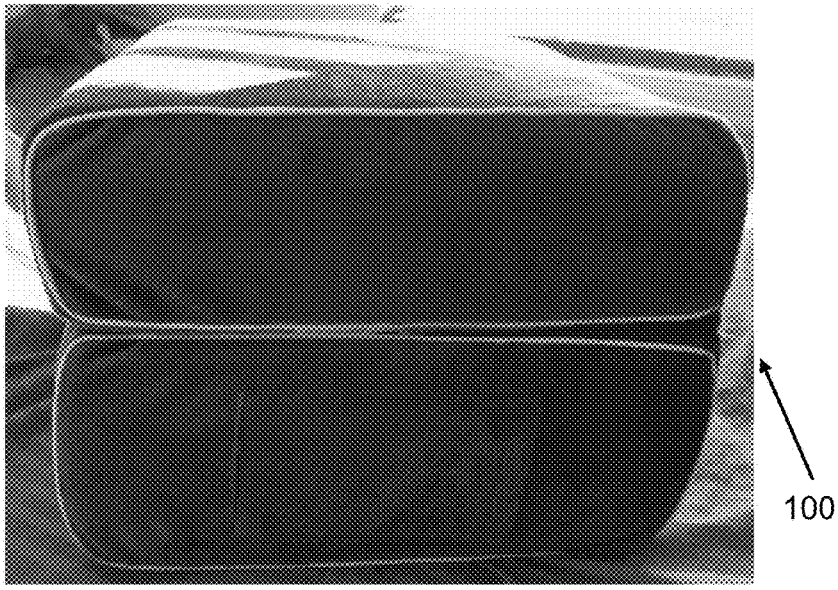
FIG. 7 is a side view of the present invention showing the pocket.
Figure 8:
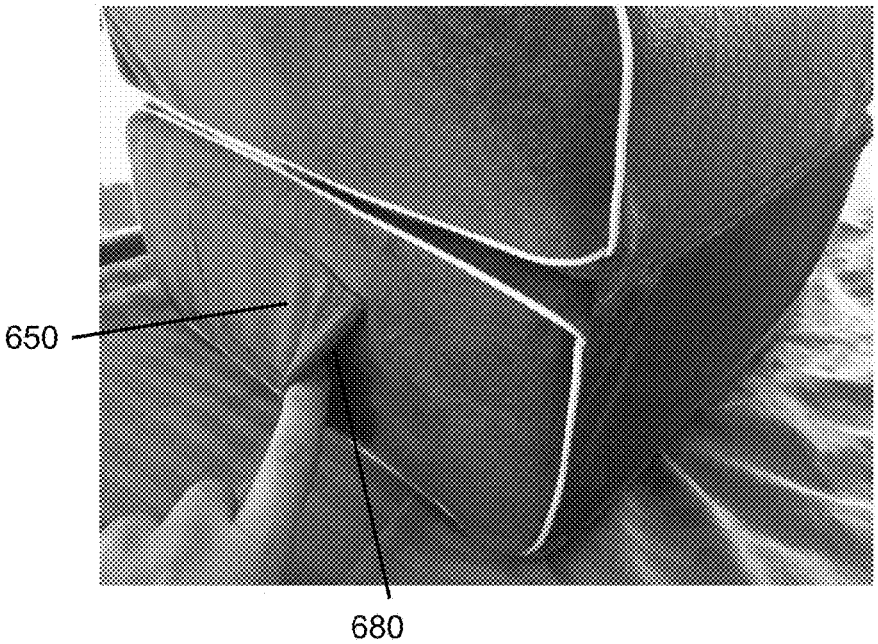
FIG. 8 shows the details of the pocket.
Figure 9:
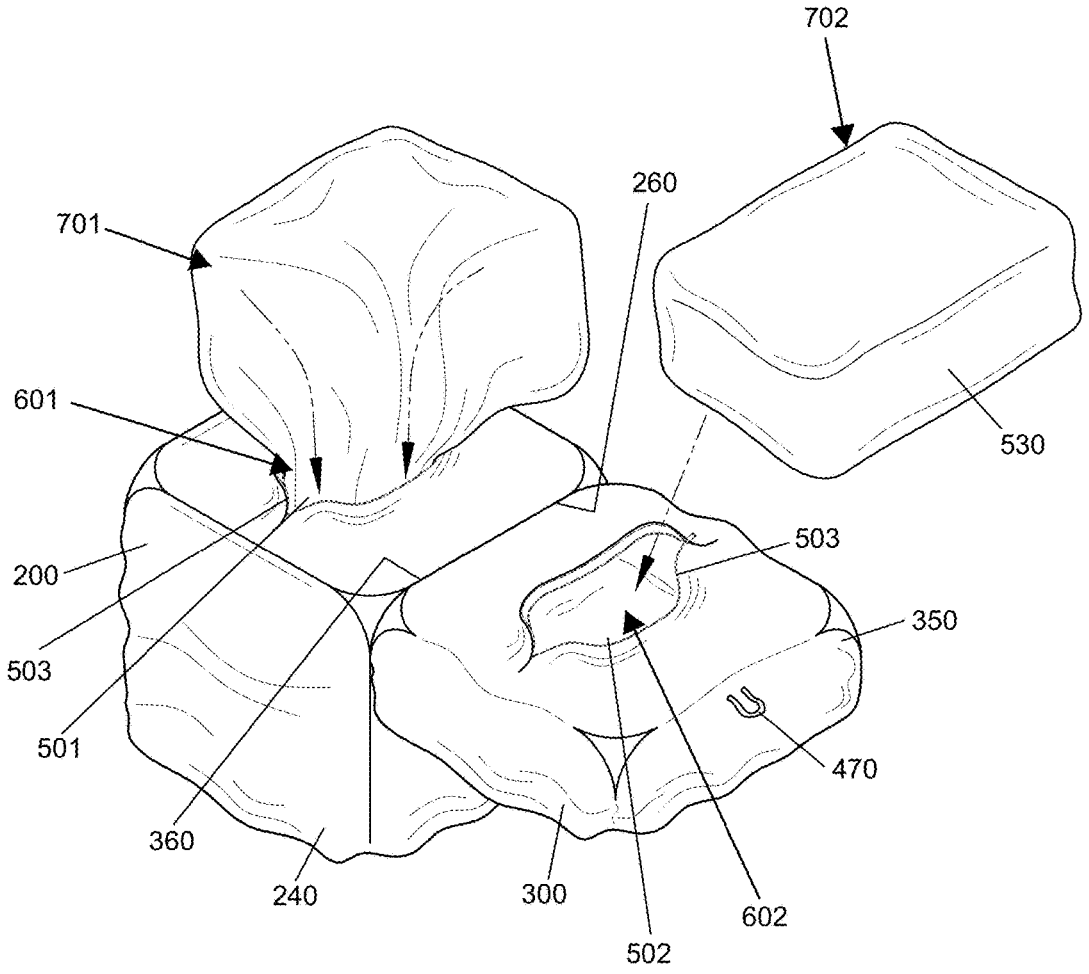
FIG. 9 is a perspective view of the details of the cushion components of the present invention.
Figure 10:
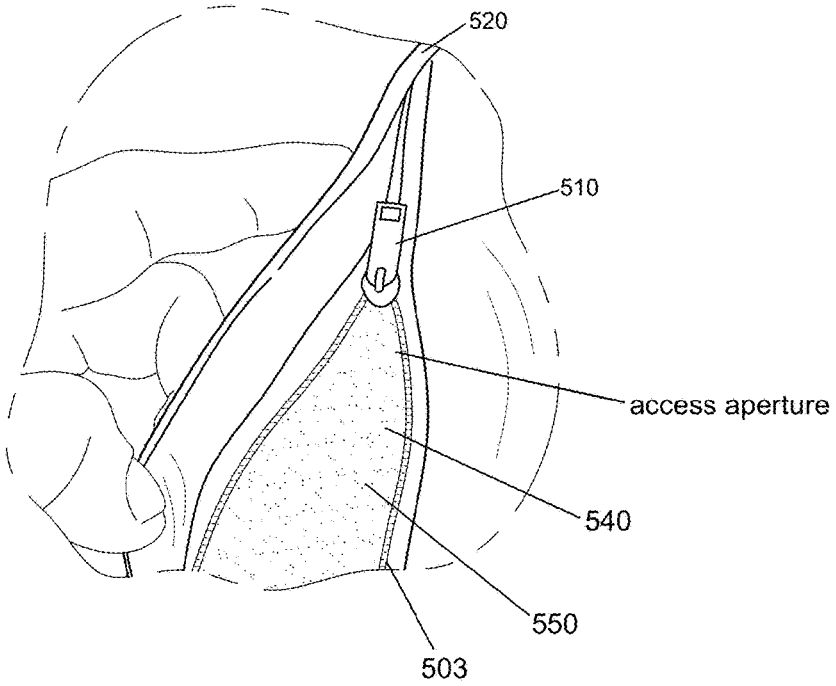
FIG. 10 is a view of the details of the stuffing material of the present invention.
Figure 12:
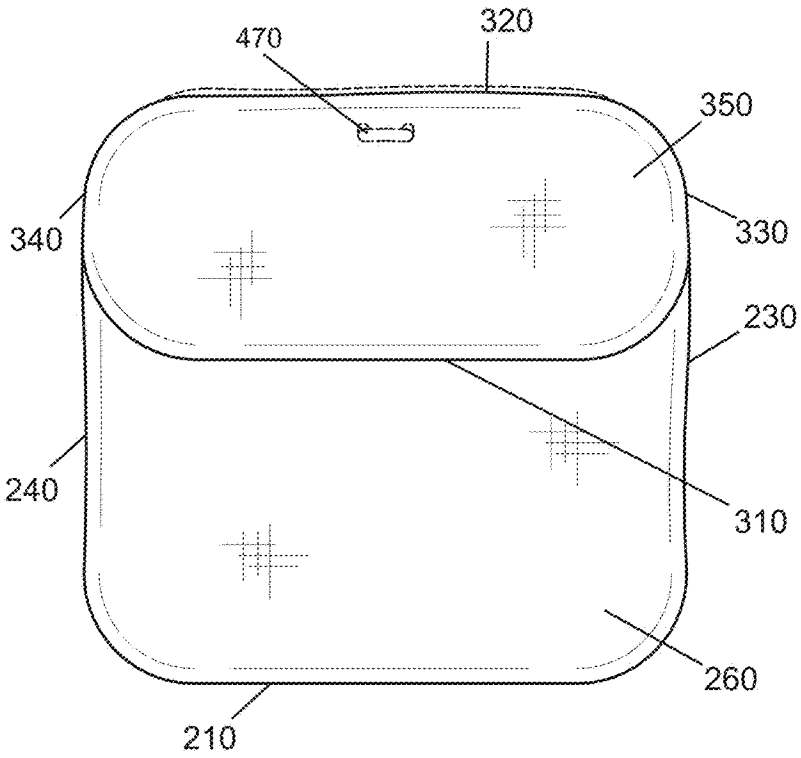
FIG. 12 is a front view in a first position for use.
Figure 11:
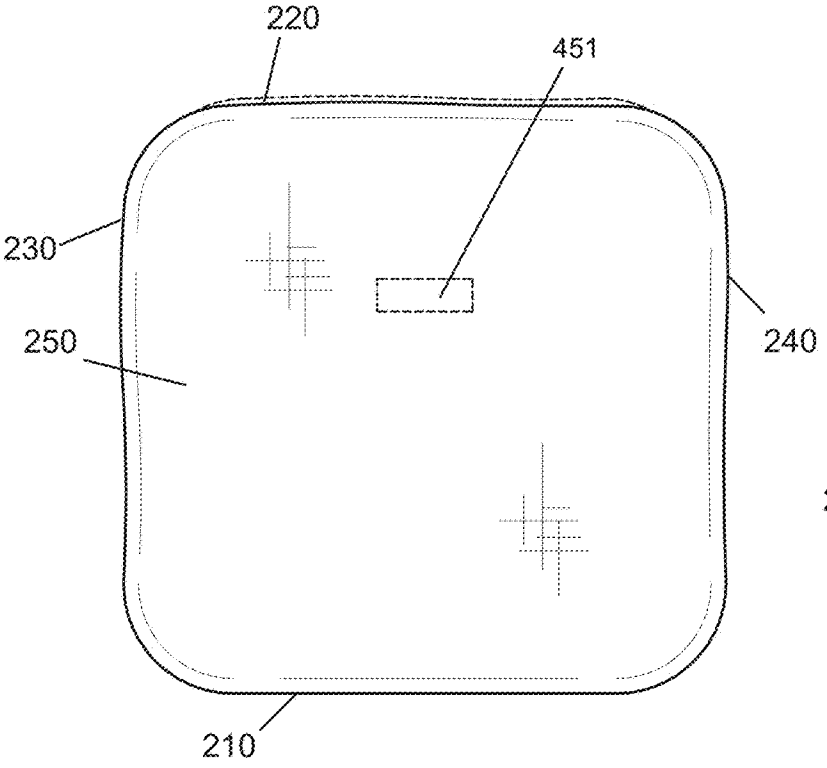
FIG. 11 is a rear view of the present invention.
Figure 13:
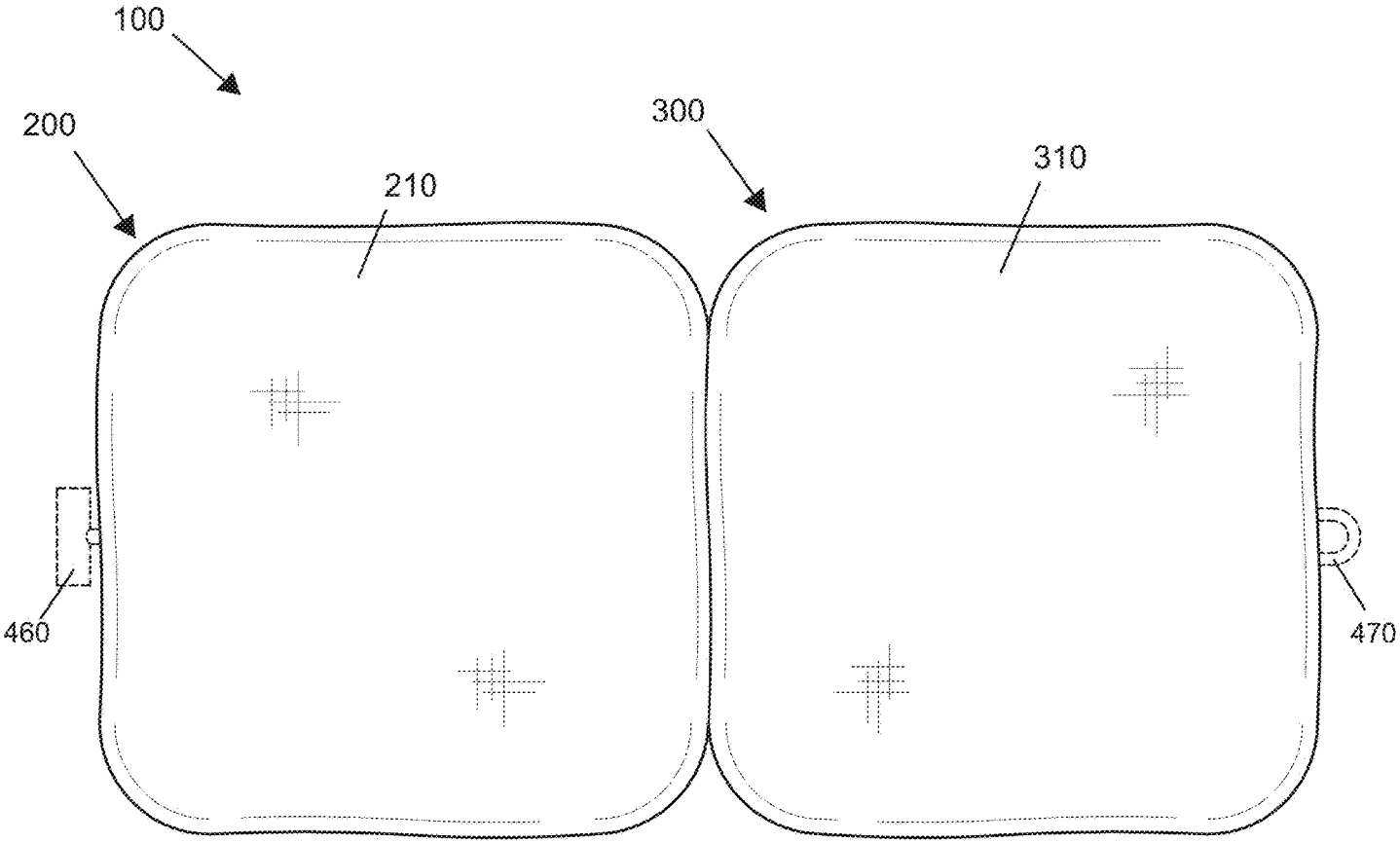
FIG. 13 is a top view of the present invention in a first position for use.
Figure 14:
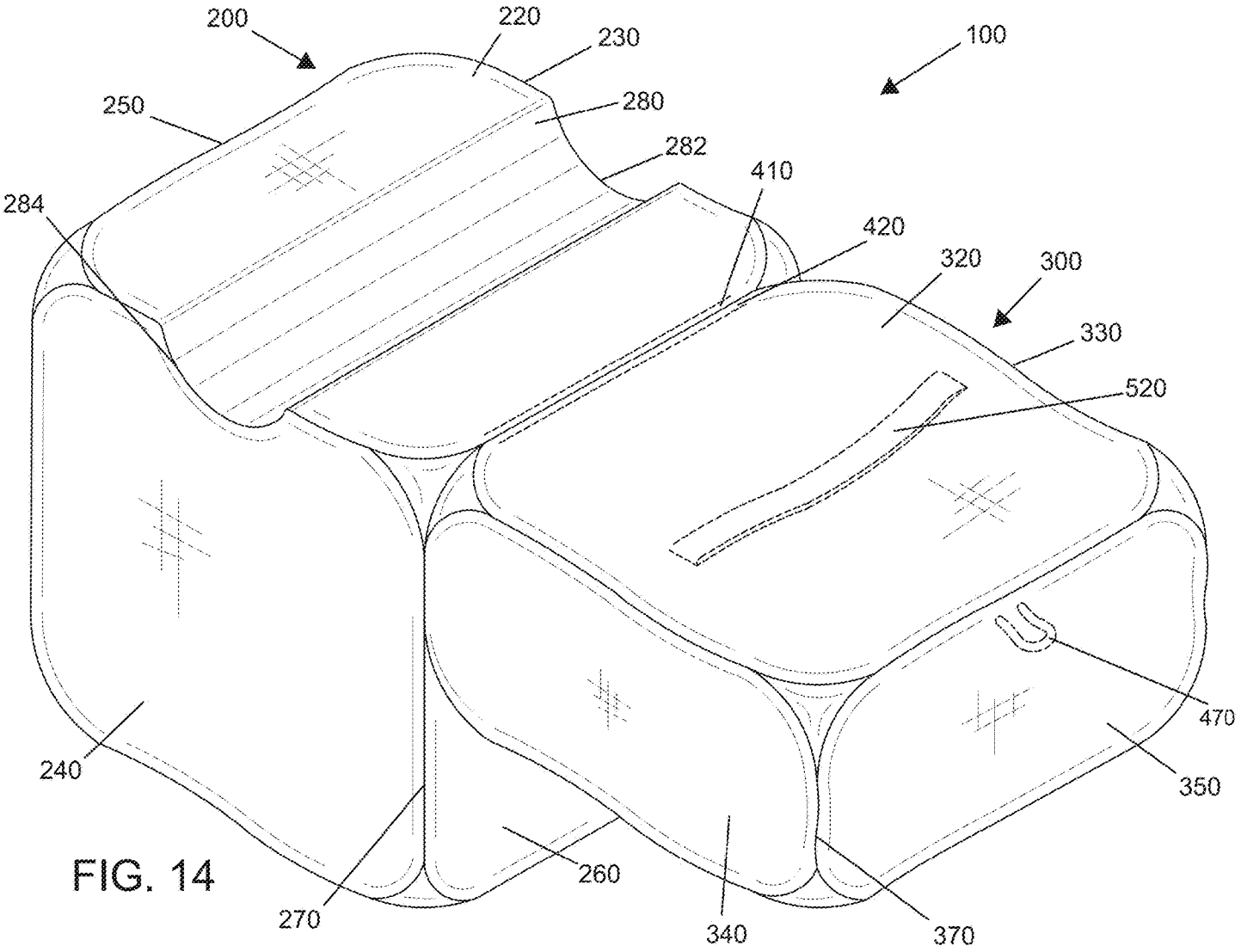
FIG. 14 is a perspective view of an alternate embodiment of the present invention.
Figure 15:
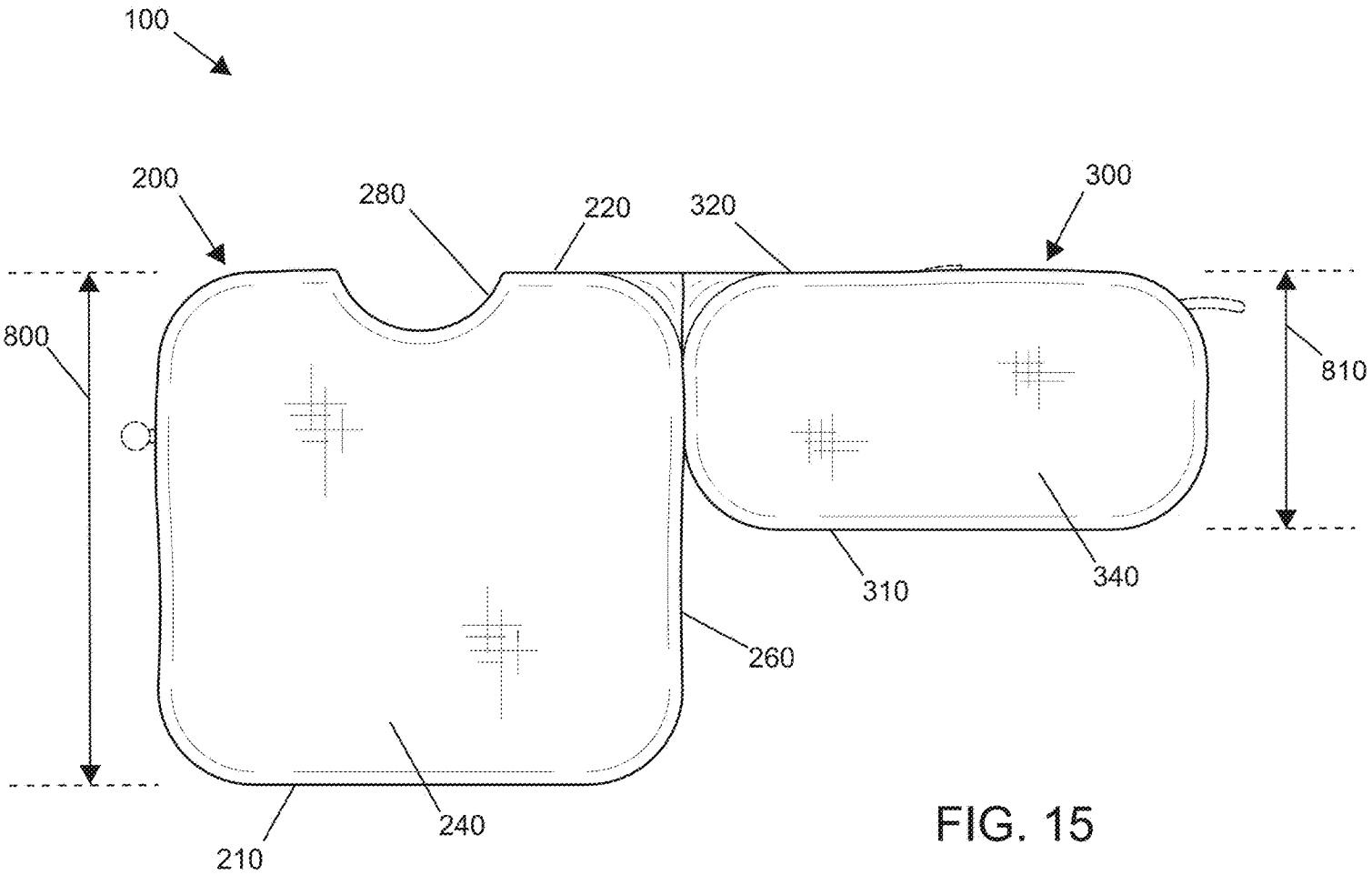
FIG. 15 is a side view of an alternate embodiment of the present invention.
Figure 16:
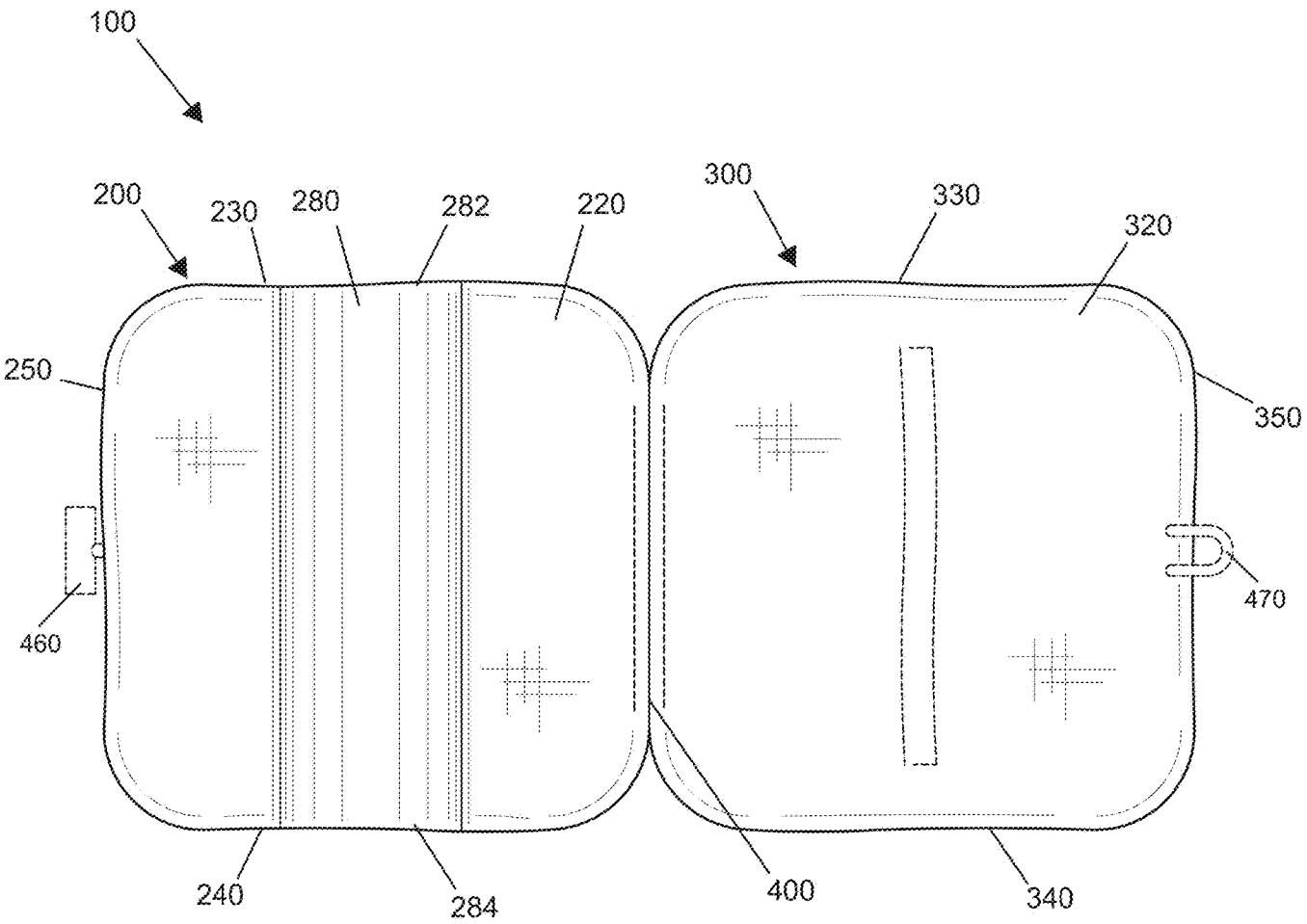
FIG. 16 is a top view of an alternate embodiment of the present invention.
Figure 17:
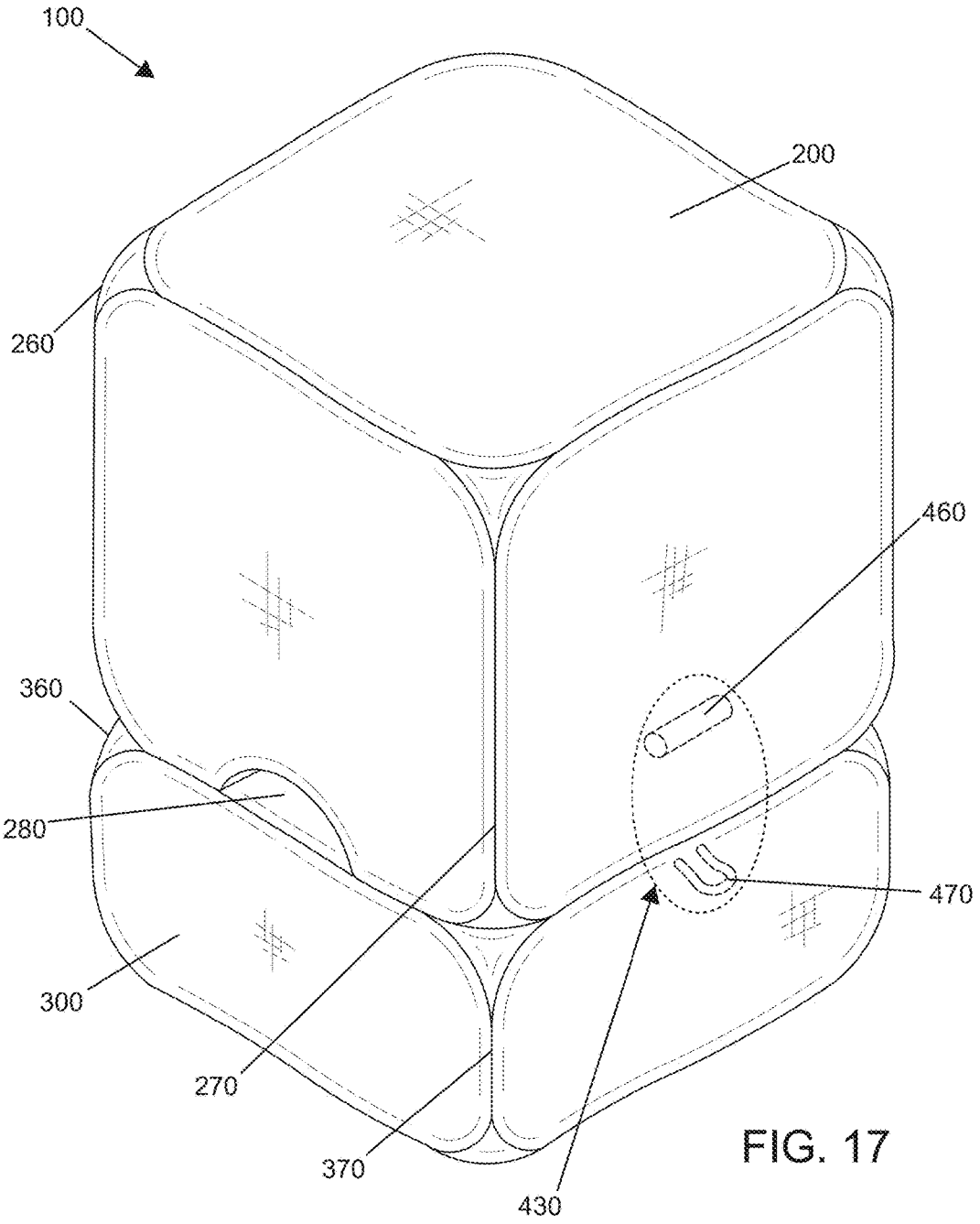
FIG. 17 is a perspective view of an alternate embodiment of the present invention.
Figure 18:
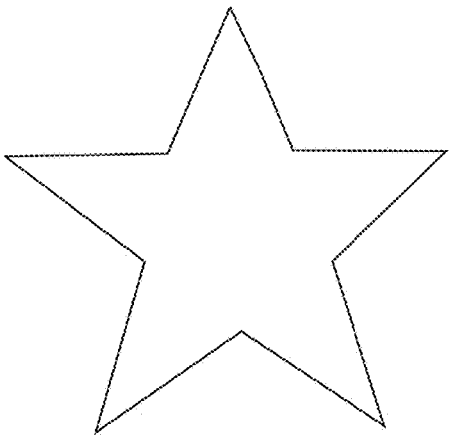
FIG. 18 is a top view of an alternate embodiment of the present invention.
Figure 19:
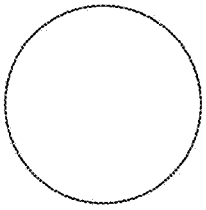
FIG. 19 is a top view of an alternate embodiment of the present invention.
Figure 20:
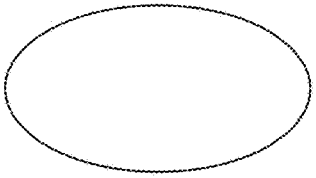
FIG. 20 is a top view of an alternate embodiment of the present invention.
Figure 21:
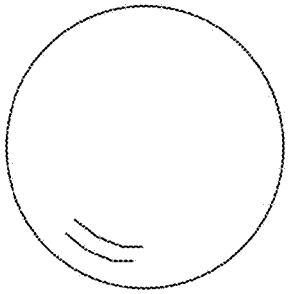
FIG. 21 is a top view of an alternate embodiment of the present invention.
Figure 22:
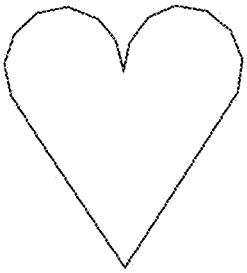
FIG. 22 is a top view of an alternate embodiment of the present invention.
Figure 23:
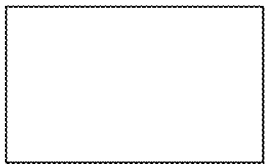
FIG. 23 is a top view of an alternate embodiment of the present invention.
Figure 24:
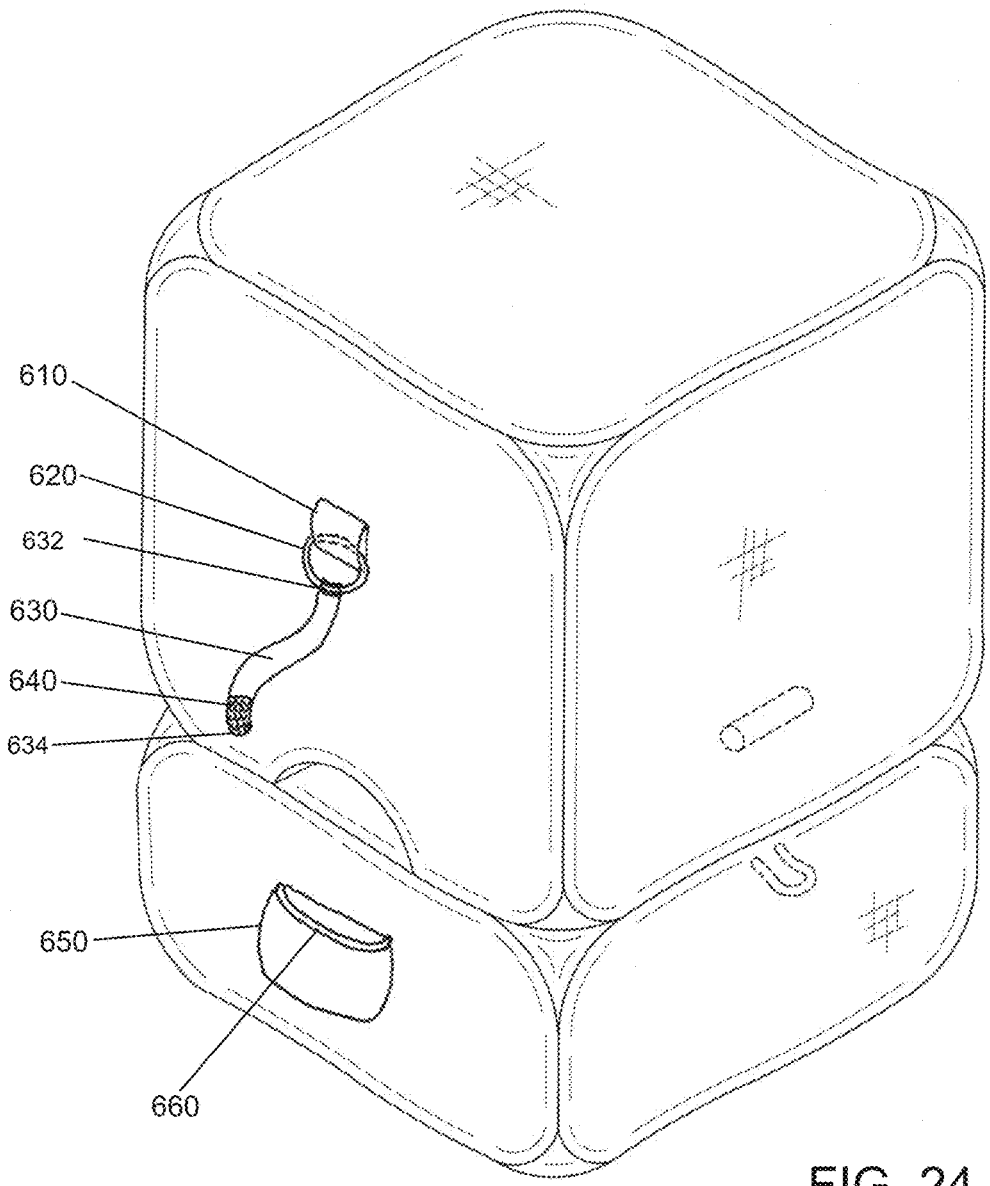
FIG. 24 is a perspective view of an alternate embodiment of the present invention showing a strap and pocket.
Figure 25:
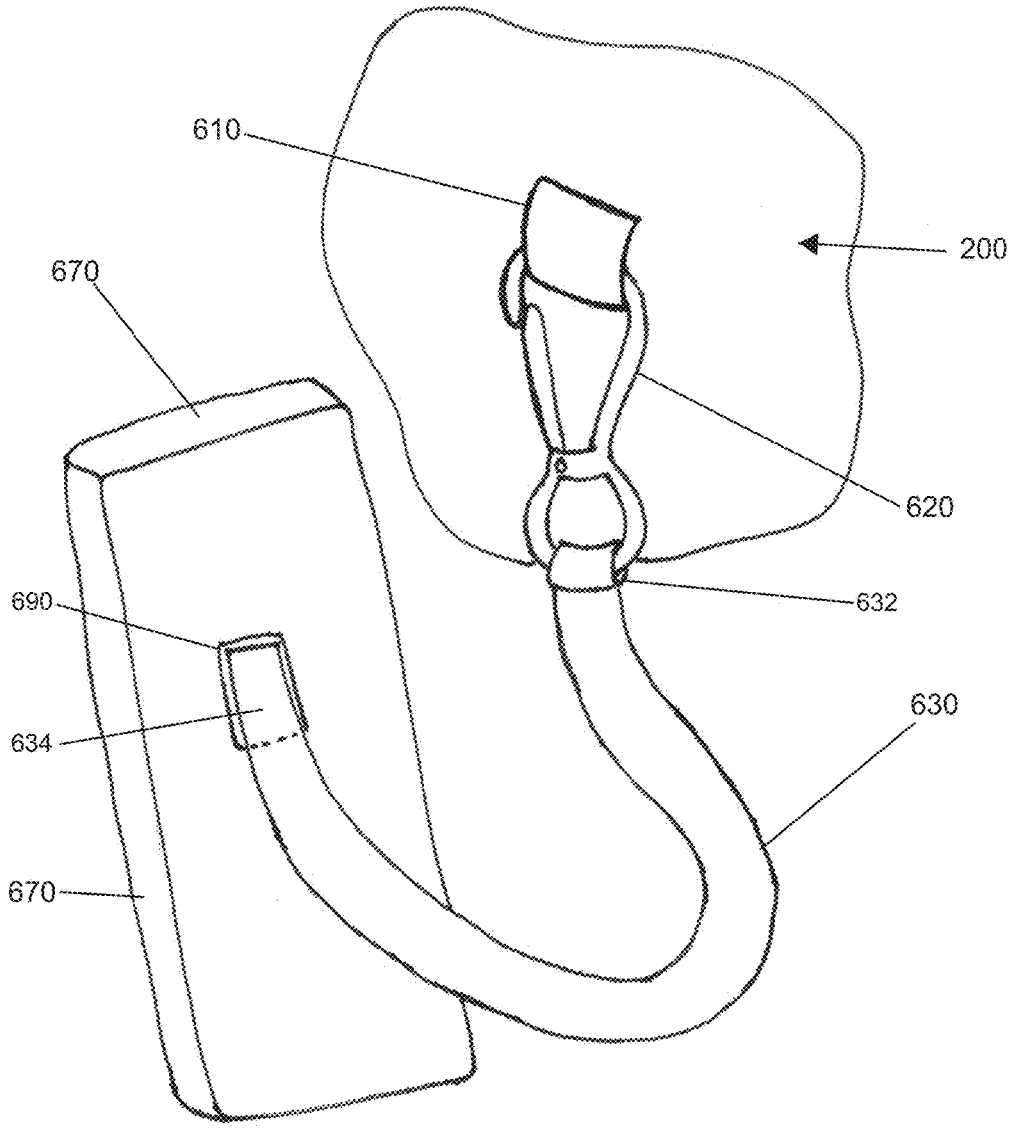
FIG. 25 is detailed in-use view of the strap in conjunction with a remote.
Figure 26:
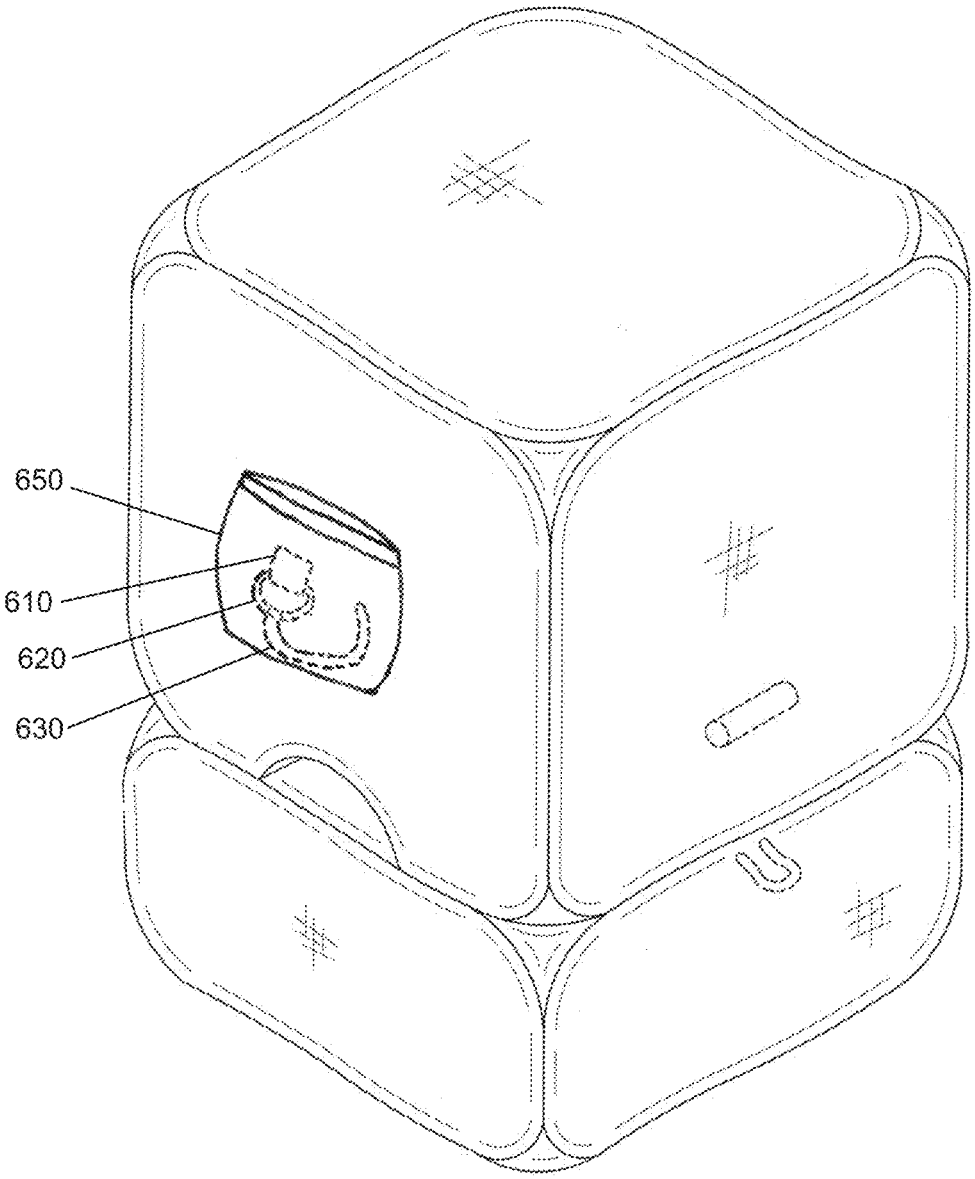
FIG. 26 is a perspective view of an alternate embodiment of the present invention showing a strap and pocket.

320 Secondary pillow bottom surface
330 Secondary pillow first side
340 Secondary pillow second side
350 Secondary pillow third side
360 Secondary pillow fourth side
370 Secondary pillow edge
400 Hinge
410 Base hinge side
420 Secondary hinge side
430 Attachment system
440 First attachment component
451 Second attachment component
452 Third attachment component
460 Button
470 First loop
501 Base pillow access aperture
502 Secondary pillow access aperture
503 Access aperture edge
510 Zipper
520 Flap
530 Pouch
540 Stuffing material
550 Granular stuffing material
601 Base pillow cavity
602 Secondary pillow access cavity
610 Second loop
620 Fourth attachment component
630 Strap
632 Strap first end
634 Strap second end
640 First hook and loop system
650 Pocket
660 Pocket lip
670 Hand held device
680 Pocket opening
690 Second hook and loop system
701 Base pillow cushion component
702 Secondary pillow cushion component
800 First height
810 Second height Referring now to FIG. 1-26, the present invention features a bi-elevation pillow system (100) for allowing two users to lie side by side with each of their heads respectively positioned at a different elevation via the pillow system (100). The system (100) comprises: a base pillow member (200) comprising a general shape of a rectangular prism having a base pillow top surface (210), a generally planar base pillow bottom surface (220) generally parallel to the base pillow top surface (210), a base pillow first side (230), a base pillow second side (240), a base pillow third side (250), and a base pillow fourth side (260); and a secondary pillow member (300) comprising a general shape of a rectangular prism having a secondary pillow top surface (310), a generally planar secondary pillow bottom surface (320) generally parallel to the secondary pillow top surface (310), a secondary pillow first side (330), a secondary pillow second side (340), a secondary pillow third side (350), and a secondary pillow fourth side (360).

In some embodiments, the system (100) further comprises a hinge (400) having a base hinge side (410) disposed on the base pillow fourth side (260) at an intersection with the base pillow bottom surface (220) and a secondary hinge side (420) disposed on the secondary pillow fourth side (360) at an intersection with the secondary pillow bottom surface (320); an attachment system (430) having a first attachment component (440) disposed on the secondary pillow third side (350), a second attachment component (451) disposed on the base pillow third side (250) and correspondingly mated to the first attachment component (440), and a third attachment component (452) disposed on the secondary pillow base surface (320) and correspondingly mated to the first attachment component (440); and a pocket (650) disposed on the base pillow second side (240) for additional storage space.

In some embodiments, the base pillow first side (230) is parallel to and opposes the base pillow second side (240), and the base pillow third side (250) is parallel to and opposes the base pillow fourth side (260). In some embodiments, the base pillow first side (230), the base pillow second side (240), the base pillow third side (250) and the base pillow fourth side (260), the base pillow top surface (210) and the base pillow bottom surface (220) are perpendicularly attached on a plurality of base pillow edges (270).

In some embodiments, the secondary pillow first side (330) is parallel to and opposes the secondary pillow second side (340), and the secondary pillow third side (350) is parallel to and opposes the secondary pillow fourth side (360). In some embodiments, the secondary pillow first side (330), the secondary pillow second side (340), the secondary pillow third side (350) the secondary pillow fourth side (360), the secondary pillow top surface (310) and the secondary pillow bottom surface (320) are perpendicularly attached on a plurality of secondary pillow edges (370).

In another embodiment, a base pillow access aperture (501) is disposed on the base pillow bottom surface (220) for accessing a base pillow cushion component (701) disposed inside a base pillow cavity (601). In another embodiment, a secondary pillow access aperture (502) is disposed on the secondary pillow bottom surface (320) for accessing a secondary pillow cushion component (702) disposed inside a secondary pillow cavity (602).

In some embodiments, the base pillow access aperture (501) is dispose midway across the base pillow bottom surface (220) from the base pillow first side (230) to the base pillow second side (240). In some embodiments, the secondary pillow access aperture (502) is dispose midway across the secondary pillow bottom surface (320) from the secondary pillow first side (330) to the secondary pillow second side (340).

In preferred embodiments, when using the present invention in a first position for storage, the base pillow bottom surface (220) interfaces with the secondary pillow bottom surface (320) and is secured in the first position via the first attachment component (440) mating with the second attachment component (451). In a second position for use, the secondary pillow is rotated about the hinge (400) 180 degrees and the first attachment component (440) mates with the third attachment component (452). The base pillow bottom surface (220) and the secondary pillow bottom surface (320) are placed on a ground surface for use.

In some embodiments, a first height (800) of the base pillow member (200) from the base pillow bottom surface (220) to the base pillow top surface (210) is greater than a second height (810) of the secondary pillow member (300) from the secondary pillow bottom surface (320) to the secondary pillow top surface (310).

In some embodiments, the second height (810) of the secondary pillow member (300) is at least 50% of the first height (800) of the base pillow member (200). In some embodiments, the second height (810) of the secondary pillow member (300) is between about 60% to 70% of the first height (800) of the base pillow member (200). In some embodiments, the second height (810) of the secondary pillow member (300) is between about 70% to 80% of the first height (800) of the base pillow member (200).

In preferred embodiments, the pocket (650) has a pocket lip (660) to reinforce a pocket opening (680). In another preferred embodiment, the pocket (650) is oriented such that the pocket opening (680) is biased towards the base pillow edge (270) formed by the base pillow second side (240) and the base pillow fourth side (260). This "side" orientation of the pocket may help in preventing any items stored inside the pocket from falling out of the pocket opening when the pillow system is rotated from the first position to the second position, and vice versa.

In a preferred embodiment, the attachment system (430) comprises a hook and loop system. In some embodiments, the first attachment component (440) comprises the hook portion of the hook and loop system. In some embodiments, the second attachment component (451) and the third attachment component (452) each comprise the loop portion of the hook and loop system. When the system is in the second position, the first attachment component mates with the third attachment component in order to conceal the hook portion of the first attachment component.

In some embodiments, the base pillow access aperture (501) and secondary pillow access aperture (502) each comprise a zipper (510) disposed on a pair of access aperture edges (502). In another embodiment, the base pillow access aperture (501) and secondary pillow access aperture (502) each comprise a hook and loop system disposed a pair of access aperture edges (503). In an alternate embodiment, the base pillow access aperture (501) and secondary pillow access aperture (502) each comprise a flap (520) disposed on an access aperture edge (503).

In some embodiments, the base pillow cushion component (701) and secondary pillow cushion component (702) are removable. In some embodiments, the base pillow cushion component (701) and secondary pillow cushion component (702) are each fully enveloped and contained by a pouch (530). In one embodiment, the base pillow cushion component (701) and secondary pillow cushion component (702) are stuffing material (540). In another embodiment, the base pillow cushion component (701) and secondary pillow cushion component (702) are granular stuffing material (550).

In some embodiments, the base top surface comprises a curved surface for cervical support.

In some embodiments, an intersecting corner of three base pillow edges (270) or three secondary pillow edges (370) is rounded.

In some embodiments, the pocket (650) comprises a fabric, an elastic material, a mesh material, a polymer material, or a combination thereof. In some embodiments, the pocket lip (660) comprises a fabric, an elastic material, a polymer material, or a combination thereof.

In an alternate embodiment, the base pillow bottom surface (220) comprises a linear channel (280) located thereon. In some embodiments, the linear channel (280) comprises a channel first end (282) and a channel second end (284). In some embodiments, the channel first end (282) is located on the base pillow first side (230) at an intersection with the base pillow bottom surface (220) and the channel second end (284) is located on the base pillow second side (240) at an intersection with the base pillow bottom surface (220). In some embodiments, the channel first end (282) is fluidly connected to the channel second end (284). In some embodiments, the linear channel (280) generally comprises the shape of a half-cylinder when a cylinder is longitudinally intersected by a coronal plane.

In alternative embodiments, the system (100) comprises an attachment system (430) having a first attachment component (440) located on the base pillow member (200) and a correspondingly mated second attachment component located on the secondary pillow member (300).

In alternative embodiments, the attachment system (430) comprises a button (460) and loop (470). In some embodiments, the button and loop as used in the present invention may be replaced or substituted by a hook and loop system. In some embodiments, the attachment system (430) comprises a hook and loop system.

In some embodiments, the system (100) comprises a base pillow member (200) having a base pillow top surface (210) comprising a general shape of a heart, a generally planar base pillow bottom surface (220) comprising a generally matching shape of a heart generally parallel to the base pillow top surface (210). In some embodiments, the system (100) comprises a base pillow side wall perpendicularly attached to the base pillow top surface (210) and the base pillow bottom surface (220) on a plurality of base pillow edges (270). In some embodiments, base pillow member (200) is fully enclosed by the base pillow top surface (210), the base pillow bottom surface (220) and the base pillow side wall.

In some embodiments, the system (100) comprises a base pillow member (200) having a base pillow top surface (210) comprising a general shape of a circle, a generally planar base pillow bottom surface (220) comprising a generally matching shape of a circle generally parallel to the base pillow top surface (210).

In some embodiments, the system (100) comprises a base pillow member (200) having a base pillow top surface (210) comprising a general shape of a star, a generally planar base pillow bottom surface (220) comprising a generally matching shape of a star generally parallel to the base pillow top surface (210).

In some embodiments, the system (100) comprises a base pillow member (200) having a base pillow top surface (210) comprising a general shape of an oval, a generally planar base pillow bottom surface (220) comprising a generally matching shape of an oval generally parallel to the base pillow top surface (210).

In some embodiments, the system (100) comprises a base pillow member (200) having a base pillow top surface (210) comprising a general shape of a rectangle, a generally planar base pillow bottom surface (220) comprising a generally matching shape of a rectangle generally parallel to the base pillow top surface (210).

In some embodiments, the system (100) comprises a base pillow member (200) comprising a general shape of a half-sphere. In some embodiments, the base pillow member (200) comprises a base pillow side wall contiguous with the base pillow top surface (210). In some embodiments, the base pillow bottom surface (220) comprises a generally planar round shape. In some embodiments, the base pillow side wall comprises a circumferential edge disposed on the base pillow bottom surface (220). In some embodiments, the base pillow top surface (210), the base pillow side wall, and the base pillow bottom surface (220) form a shape of a half-sphere. In some embodiments, the base pillow member (200) is fully enclosed by the base pillow top surface (210), the base pillow bottom surface (220) and the base pillow side wall.

In some embodiments, the system (100) comprises a base pillow member (200) having a base pillow top surface (210) comprising a geometric shape, a generally planar base pillow bottom surface (220) comprising a generally matching geometric shape generally parallel to the base pillow top surface (210).

In some embodiments, the system (100) comprises a base pillow member (200) having a base pillow top surface (210) comprising a polygonal shape, a generally planar base pillow bottom surface (220) comprising a generally matching polygonal shape generally parallel to the base pillow top surface (210).

In some embodiments, the system (100) comprises a base pillow member (200) having a base pillow top surface (210) comprising a elliptical shape, a generally planar base pillow bottom surface (220) comprising a generally matching elliptical shape generally parallel to the base pillow top surface (210).

In some embodiments, the base pillow bottom surface (220) comprises a linear channel (280) located thereon. In some embodiments, the linear channel (280) comprises a channel first end (282) and a channel second end (284). In some embodiments, the channel first end (282) is located on the base pillow side wall at an intersection with the base pillow bottom surface (220), and the channel second end (284) is located on an opposing side of the base pillow side wall at an intersection with the base pillow bottom surface (220). In some embodiments, the channel first end (282) is fluidly connected to the channel second end (284). In some embodiments, the linear channel (280) generally comprises the shape of a half-cylinder when a cylinder is longitudinally intersected by a coronal plane.

In some embodiments, the system (100) comprises a hinge (400) having a base hinge side (410) located on the base pillow side wall at an intersection with the base pillow bottom surface (220) and a secondary hinge side (420) located on the secondary pillow side wall at an intersection with the secondary pillow bottom surface (320).

In some embodiments, the system (100) comprises a secondary pillow member (300) having a secondary pillow top surface (310) comprising a general shape of a heart, a generally planar secondary pillow bottom surface (320) comprising a generally matching shape of a heart generally parallel to the secondary pillow top surface (310). In some embodiments, the system (100) comprises a secondary pillow side wall perpendicularly attached to the secondary pillow top surface (310) and the secondary pillow bottom surface (320) on a plurality of secondary pillow edges (370). In some embodiments, secondary pillow member (300) is fully enclosed by the secondary pillow top surface (310), the secondary pillow bottom surface (320) and the secondary pillow side wall.

In some embodiments, the system (100) comprises a secondary pillow member (300) having a secondary pillow top surface (310) comprising a general shape of a circle, a generally planar secondary pillow bottom surface (320) comprising a generally matching shape of a circle generally parallel to the secondary pillow top surface (310).

In some embodiments, the system (100) comprises a secondary pillow member (200) having a secondary pillow top surface (310) comprising a general shape of a star, a generally planar secondary pillow bottom surface (320) comprising a generally matching shape of a star generally parallel to the secondary pillow top surface (310).

In some embodiments, the system (100) comprises a secondary pillow member (200) having a secondary pillow top surface (310) comprising a general shape of an oval, a generally planar secondary pillow bottom surface (320) comprising a generally matching shape of an oval generally parallel to the secondary pillow top surface (310).

In some embodiments, the system (100) comprises a secondary pillow member (200) having a secondary pillow top surface (310) comprising a general shape of a rectangle, a generally planar secondary pillow bottom surface (320) comprising a generally matching shape of a rectangle generally parallel to the secondary pillow top surface (310).

In some embodiments, the system (100) comprises a secondary pillow member (300) comprising a general shape of a half-sphere. In some embodiments, the secondary pillow member (300) comprises a secondary pillow side wall contiguous with the secondary pillow top surface (310). In some embodiments, the secondary pillow bottom surface (320) comprises a generally planar round shape. In some embodiments, the secondary pillow side wall comprises a circumferential edge disposed on the secondary pillow bottom surface (320). In some embodiments, the secondary pillow top surface (310), the secondary pillow side wall, and the secondary pillow bottom surface (320) form a shape of a half-sphere. In some embodiments, the secondary pillow member (300) is fully enclosed by the secondary pillow top surface (310), the secondary pillow bottom surface (320) and the secondary pillow side wall.

In some embodiments, the system (100) comprises a secondary pillow member (300) having a secondary pillow top surface (310) comprising a geometric shape, a generally planar secondary pillow bottom surface (320) comprising a generally matching geometric shape generally parallel to the secondary pillow top surface (310).

In some embodiments, the system (100) comprises a secondary pillow member (300) having a secondary pillow top surface (310) comprising a polygonal shape, a generally planar secondary pillow bottom surface (320) comprising a generally matching polygonal shape generally parallel to the secondary pillow top surface (310).

In some embodiments, the system (100) comprises a secondary pillow member (300) having a secondary pillow top surface (310) comprising a elliptical shape, a generally planar secondary pillow bottom surface (320) comprising a generally matching elliptical shape generally parallel to the secondary pillow top surface (310).

In some embodiments, a second loop (610) is disposed on the base pillow second side (240), wherein a fourth attachment component (620) is connected through the second loop (610); wherein a strap (630) is attached to the fourth attachment component (620).

In some embodiments, the pocket (650) and the second loop (610) and strap (630) system may be on any side or on the underside of the pillow case when it is opened and laying flat.

In some embodiments, the fourth attachment component (620) has a bendable hooking mechanism so that it can be opened or closed to attach to the second loop (610). In some embodiments, the fourth attachment component (620) can be a ring, a keychain, a hook, a carabineer, or a combination thereof.

In some embodiments, the strap (630) has a strap first end (632) that is attached to the fourth attachment component (620), wherein the strap (630) has a strap second end (634) comprising a first hook and loop system (640). In some embodiments, the strap (630) comprises a fabric, an elastic material, a cord, or a combination thereof.

In some embodiments, the first hook and loop system (640) fastens onto a second hook and loop system (690) located on the back of a hand held device (670) to prevent the hand held device (670) from being lost, for example, between couch cushions or under a blanket. In some embodiments, the hand held device (670) is a television remote, a stereo remote, a cell phone, a house phone, or the like.

In some embodiments, a pocket (650) is disposed on the secondary pillow second side (340) for additional storage space. The pocket (650) has a pocket lip (660) to reinforce an opening of the pocket. In some embodiments, the pocket (650) comprises a fabric, an elastic material, a mesh material, a polymer material, or a combination thereof. In some embodiments, the pocket lip (660) comprises a fabric, an elastic material, a polymer material, or a combination thereof. In some embodiments, the pocket (650) is located on the same pillow and on the same surface as the second loop (610). In some embodiments, the second loop (610), the third attachment component (620) and the strap (630) may be located inside the pocket (650) in order to hide them from sight. The strap (630) will come out from the pocket (650) when it is attached to a hand held device (670).

As used herein, the term "about" refers to plus or minus 10% of the referenced number. For example, an embodiment wherein the hinge is about 10 inches in length includes a hinge that is between 9 and 11 inches in length.

The disclosures of the following U.S. Patents are incorporated in their entirety by reference herein: U.S. Pat. No. 5,029,350. U.S. Pat. No. 5,765,245; U.S. Pat. No. 7,305,728; U.S. Pat. Pub. No. 2008/0028530; U.S. Pat. No. D 387,599; U.S. Pat. No. D 446,676.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A bi-elevation pillow system (100) for allowing two users to lie side by side with each of their heads respectively positioned at a different elevation via the pillow system (100), wherein said system (100) comprises:

(a) a base pillow member (200) comprising a general shape of a rectangular prism having a base pillow top surface (210), a generally planar base pillow bottom surface (220) generally parallel to the base pillow top surface (210), a base pillow first side (230), a base pillow second side (240), a base pillow third side (250), and a base pillow fourth side (260), wherein the base pillow first side (230) is parallel to and opposes the base pillow second side (240), wherein the base pillow third side (250) is parallel to and opposes the base pillow fourth side (260), wherein the base pillow first side (230), the base pillow second side (240), the base pillow third side (250) and the base pillow fourth side (260), the base pillow top surface (210) and the base pillow bottom surface (220) are perpendicularly attached on a plurality of base pillow edges (270), wherein a base pillow access aperture (501) is disposed on the base pillow bottom surface (220) for accessing a base pillow cushion component (701) disposed inside a base pillow cavity (601);

(b) a secondary pillow member (300) comprising a general shape of a rectangular prism having a secondary pillow top surface (310), a generally planar secondary pillow bottom surface (320) generally parallel to the secondary pillow top surface (310), a secondary pillow first side (330), a secondary pillow second side (340), a secondary pillow third side (350), and a secondary pillow fourth side (360), wherein the secondary pillow first side (330) is parallel to and opposes the secondary pillow second side (340), wherein the secondary pillow third side (350) is parallel to and opposes the secondary pillow fourth side (360), wherein the secondary pillow first side (330), the secondary pillow second side (340), the secondary pillow third side (350) the secondary pillow fourth side (360), the secondary pillow top surface (310) and the secondary pillow bottom surface (320) are perpendicularly attached on a plurality of secondary pillow edges (370), wherein a secondary pillow access aperture (502) is disposed on the secondary pillow bottom surface (320) for accessing a secondary pillow cushion component (702) disposed inside a secondary pillow cavity (602);

(c) a hinge (400) having a base hinge side (410) disposed on the base pillow fourth side (260) at an intersection with the base pillow bottom surface (220) and a secondary hinge side (420) disposed on the secondary pillow fourth side (360) at an intersection with the secondary pillow bottom surface (320); and (d) an attachment system (430) having a first attachment component (440) disposed on the secondary pillow third side (350), a second attachment component (451) disposed on the base pillow third side (250) and correspondingly mated to the first attachment component (440), and a third attachment component (452) disposed on the secondary pillow base surface (320) and correspondingly mated to the first attachment component (440); and (e) a pocket (650) disposed on the base pillow second side (240) for additional storage space, wherein the pocket (650) has a pocket lip (660) to reinforce a pocket opening (680), wherein the pocket (650) is oriented such that the pocket opening (680) is biased towards the base pillow edge (270) formed by the base pillow second side (240) and the base pillow fourth side (260);

wherein in a first position for storage, the base pillow bottom surface (220) interfaces with the secondary pillow bottom surface (320) and is secured in the first position via the first attachment component (440) mating with the second attachment component (451);

wherein in a second position for use, the secondary pillow is rotated about the hinge (400) 180 degrees, wherein the first attachment component (440) mates with the third attachment component (452), wherein the base pillow bottom surface (220) and the secondary pillow bottom surface (320) are placed on a ground surface for use; and wherein a first height (800) of the base pillow member (200) from the base pillow bottom surface (220) to the base pillow top surface (210) is greater than a second height (810) of the secondary pillow member (300) from the secondary pillow bottom surface (320) to the secondary pillow top surface (310).

2. The system (100) of claim 1, wherein the attachment system (430) comprises a hook and loop system.

3. The system (100) of claim 1, wherein the base pillow access aperture (501) and secondary pillow access aperture (502) each comprise a zipper (510) disposed on a pair of access aperture edges (502).

4. The system (100) of claim 1, wherein the base pillow access aperture (501) and secondary pillow access aperture (502) each comprise a hook and loop system disposed a pair of access aperture edges (503).

5. The system (100) of claim 1, wherein the base pillow access aperture (501) and secondary pillow access aperture (502) each comprise a flap (520) disposed on an access aperture edge (503).

6. The system (100) of claim 1, wherein the base pillow cushion component (701) and secondary pillow cushion component (702) are removable.

7. The system (100) of claim 6, wherein the base pillow cushion component (701) and secondary pillow cushion component (702) are each fully enveloped and contained by a pouch (530).

8. The system (100) of claim 1, wherein the base pillow cushion component (701) and secondary pillow cushion component (702) are stuffing material (540).

9. The system (100) of claim 1, wherein the base pillow cushion component (701) and secondary pillow cushion component (702) are granular stuffing material (550).

10. The system (100) of claim 1, wherein the base top surface comprises a curved surface for cervical support.

11. The system (100) of claim 1, wherein an intersecting corner of three base pillow edges (270) or three secondary pillow edges (370) is rounded.

12. The system (100) of claim 1, wherein the pocket (650) comprises a fabric, an elastic material, a mesh material, a polymer material, or a combination thereof.

13. The system (100) of claim 1, wherein the pocket lip (660) comprises a fabric, an elastic material, a polymer material, or a combination thereof.

14. The system (100) of claim 1, wherein the second height (810) of the secondary pillow member (300) is at least 50% of the first height (800) of the base pillow member (200).

15. The system (100) of claim 1, wherein the second height (810) of the secondary pillow member (300) is between about 60% to 70% of the first height (800) of the base pillow member (200).

16. The system (100) of claim 1, wherein the second height (810) of the secondary pillow member (300) is between about 70% to 80% of the first height (800) of the base pillow member (200).

17. The system (100) of claim 1, wherein the base pillow access aperture (501) is dispose midway across the base pillow bottom surface (220) from the base pillow first side (230) to the base pillow second side (240).

18. The system (100) of claim 1, wherein the secondary pillow access aperture (502) is dispose midway across the secondary pillow bottom surface (320) from the secondary pillow first side (330) to the secondary pillow second side (340).

19. A bi-elevation pillow system (100) for allowing two users to lie side by side with each of their heads respectively positioned at a different elevation via the pillow system (100), wherein said system (100) comprises:

(a) a base pillow member (200) comprising a general shape of a rectangular prism having a base pillow top surface (210), a generally planar base pillow bottom surface (220) generally parallel to the base pillow top surface (210), a base pillow first side (230), a base pillow second side (240), a base pillow third side (250), and a base pillow fourth side (260), wherein the base pillow first side (230) is parallel to and opposes the base pillow second side (240), wherein the base pillow third side (250) is parallel to and opposes the base pillow fourth side (260), wherein the base pillow first side (230), the base pillow second side (240), the base pillow third side (250) and the base pillow fourth side (260), the base pillow top surface (210) and the base pillow bottom surface (220) are perpendicularly attached on a plurality of base pillow edges (270), wherein a base pillow access aperture (501) is disposed on the base pillow bottom surface (220) for accessing a base pillow cushion component (701) disposed inside a base pillow cavity (601);

(b) a secondary pillow member (300) comprising a general shape of a rectangular prism having a secondary pillow top surface (310), a generally planar secondary pillow bottom surface (320) generally parallel to the secondary pillow top surface (310), a secondary pillow first side (330), a secondary pillow second side (340), a secondary pillow third side (350), and a secondary pillow fourth side (360), wherein the secondary pillow first side (330) is parallel to and opposes the secondary pillow second side (340), wherein the secondary pillow third side (350) is parallel to and opposes the secondary pillow fourth side (360), wherein the secondary pillow first side (330), the secondary pillow second side (340), the secondary pillow third side (350) the secondary pillow fourth side (360), the secondary pillow top surface (310) and the secondary pillow bottom surface (320) are perpendicularly attached on a plurality of secondary pillow edges (370), wherein a secondary pillow access aperture (502) is disposed on the secondary pillow bottom surface (320) for accessing a secondary pillow cushion component (702) disposed inside a secondary pillow cavity (602);

(c) a hinge (400) having a base hinge side (410) disposed on the base pillow fourth side (260) at an intersection with the base pillow bottom surface (220) and a secondary hinge side (420) disposed on the secondary pillow fourth side (360) at an intersection with the secondary pillow bottom surface (320); and wherein in a first position for storage, the base pillow bottom surface (220) interfaces with the secondary pillow bottom surface (320);

wherein in a second position for use, the secondary pillow is rotated about the hinge (400) 180 degrees, wherein the base pillow bottom surface (220) and the secondary pillow bottom surface (320) are placed on a ground surface for use; and wherein a first height (800) of the base pillow member (200) from the base pillow bottom surface (220) to the base pillow top surface (210) is greater than a second height (810) of the secondary pillow member (300) from the secondary pillow bottom surface (320) to the secondary pillow top surface (310).

20. A bi-elevation pillow system (100) for allowing two users to lie side by side with each of their heads respectively positioned at a different elevation via the pillow system (100), wherein said system (100) consisting of:

(a) a base pillow member (200) consisting of a general shape of a rectangular prism consisting of a base pillow top surface (210), a generally planar base pillow bottom surface (220) generally parallel to the base pillow top surface (210), a base pillow first side (230), a base pillow second side (240), a base pillow third side (250), and a base pillow fourth side (260), wherein the base pillow first side (230) is parallel to and opposes the base pillow second side (240), wherein the base pillow third side (250) is parallel to and opposes the base pillow fourth side (260), wherein the base pillow first side (230), the base pillow second side (240), the base pillow third side (250) and the base pillow fourth side (260), the base pillow top surface (210) and the base pillow bottom surface (220) are perpendicularly attached on a plurality of base pillow edges (270), wherein a base pillow access aperture (501) is disposed on the base pillow bottom surface (220) for accessing a base pillow cushion component (701) disposed inside a base pillow cavity (601);

(b) a secondary pillow member (300) consisting of a general shape of a rectangular prism consisting of a secondary pillow top surface (310), a generally planar secondary pillow bottom surface (320) generally parallel to the secondary pillow top surface (310), a secondary pillow first side (330), a secondary pillow second side (340), a secondary pillow third side (350), and a secondary pillow fourth side (360), wherein the secondary pillow first side (330) is parallel to and opposes the secondary pillow second side (340), wherein the secondary pillow third side (350) is parallel to and opposes the secondary pillow fourth side (360), wherein the secondary pillow first side (330), the secondary pillow second side (340), the secondary pillow third side (350) the secondary pillow fourth side (360), the secondary pillow top surface (310) and the secondary pillow bottom surface (320) are perpendicularly attached on a plurality of secondary pillow edges (370), wherein a secondary pillow access aperture (502) is disposed on the secondary pillow bottom surface (320) for accessing a secondary pillow cushion component (702) disposed inside a secondary pillow cavity (602);

(c) a hinge (400) consisting of a base hinge side (410) disposed on the base pillow fourth side (260) at an intersection with the base pillow bottom surface (220) and a secondary hinge side (420) disposed on the secondary pillow fourth side (360) at an intersection with the secondary pillow bottom surface (320); and (d) an attachment system (430) consisting of a first attachment component (440) disposed on the secondary pillow third side (350), a second attachment component (451) disposed on the base pillow third side (250) and correspondingly mated to the first attachment component (440), and a third attachment component (452) disposed on the secondary pillow base surface (320) and correspondingly mated to the first attachment component (440); and (e) a pocket (650) disposed on the base pillow second side (240) for additional storage space, wherein the pocket (650) has a pocket lip (660) to reinforce a pocket opening (680), wherein the pocket (650) is oriented such that the pocket opening (680) is biased towards the base pillow edge (270) formed by the base pillow second side (240) and the base pillow fourth side (260);

wherein in a first position for storage, the base pillow bottom surface (220) interfaces with the secondary pillow bottom surface (320) and is secured in the first position via the first attachment component (440) mating with the second attachment component (451);

wherein in a second position for use, the secondary pillow is rotated about the hinge (400) 180 degrees, wherein the first attachment component (440) mates with the third attachment component (452), wherein the base pillow bottom surface (220) and the secondary pillow bottom surface (320) are placed on a ground surface for use; and wherein a first height (800) of the base pillow member (200) from the base pillow bottom surface (220) to the base pillow top surface (210) is greater than a second height (810) of the secondary pillow member (300) from the secondary pillow bottom surface (320) to the secondary pillow top surface (310).

* * * * *